US006928985B2

(12) United States Patent
Boecking

(10) Patent No.: US 6,928,985 B2
(45) Date of Patent: Aug. 16, 2005

(54) FUEL INJECTION DEVICE FOR INTERNAL COMBUSTION ENGINES, HAVING A COMMON RAIL INJECTOR FUEL SYSTEM

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 107 days.

(21) Appl. No.: 10/332,376

(22) PCT Filed: Apr. 18, 2002

(86) PCT No.: PCT/DE02/01435

§ 371 (c)(1),
(2), (4) Date: Aug. 1, 2003

(87) PCT Pub. No.: WO02/090756

PCT Pub. Date: Nov. 14, 2002

(65) Prior Publication Data

US 2004/0025842 A1 Feb. 12, 2004

(51) Int. Cl.[7] ..... F02M 37/04
(52) U.S. Cl. ..... 123/467; 123/446; 239/93
(58) Field of Search ..... 123/467, 447, 123/446, 500, 501, 456, 299, 300; 239/88–95

(56) References Cited

U.S. PATENT DOCUMENTS

| | | | | | |
|---|---|---|---|---|---|
| 4,798,186 | A | * | 1/1989 | Ganser | 123/467 |
| 5,067,658 | A | * | 11/1991 | De Matthaeis et al. | 239/124 |
| 5,694,903 | A | * | 12/1997 | Ganser | 123/496 |
| 5,842,640 | A | | 12/1998 | Ganser | |
| 6,213,098 | B1 | * | 4/2001 | Kato et al. | 123/467 |
| 6,244,245 | B1 | * | 6/2001 | Boecking | 123/300 |
| 6,293,254 | B1 | * | 9/2001 | Crofts et al. | 123/467 |

FOREIGN PATENT DOCUMENTS

DE 198 26 791 A 12/1999

* cited by examiner

*Primary Examiner*—Carl S. Miller
(74) *Attorney, Agent, or Firm*—Ronald E. Greigg

(57) ABSTRACT

A fuel injection device includes a housing with an injection end and a recess extending in the housing. An axially movable valve element disposed in the recess cooperates with a valve seat, which axially defines a control chamber. A sleeve part radially defines the control chamber. A device presses the sleeve part against a first housing portion and the valve element in the direction of the injection end, and includes separate prestressing devices acting one upon the valve element and the other upon the sleeve part.

19 Claims, 4 Drawing Sheets

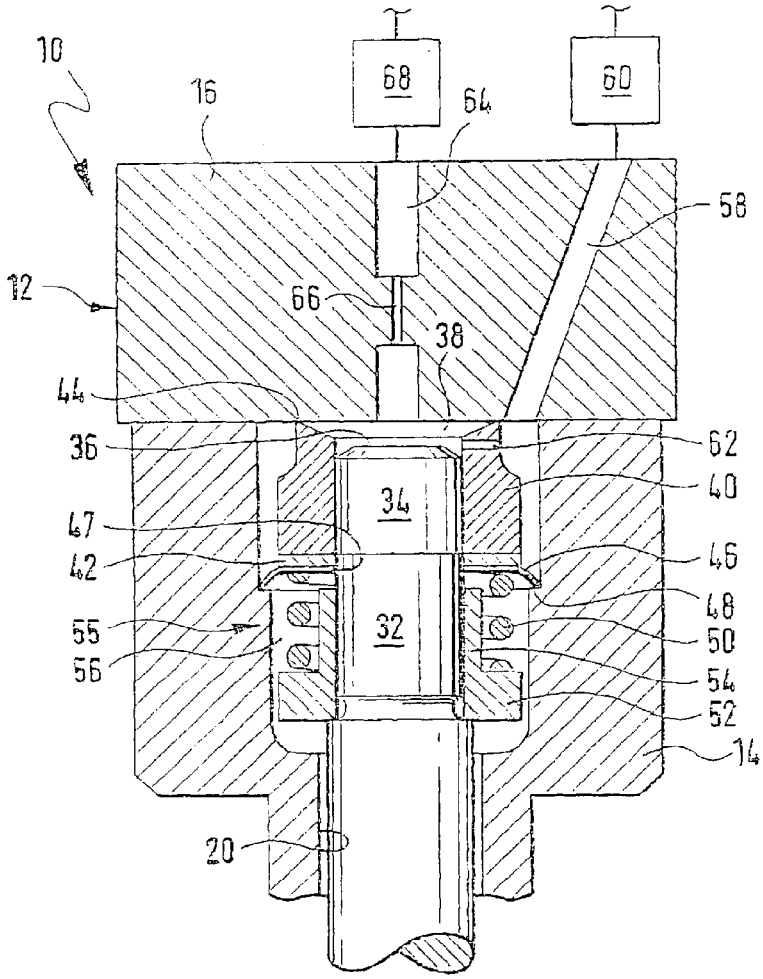
Fig. 1
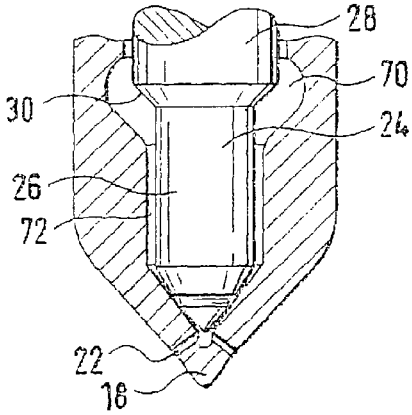
Fig. 2
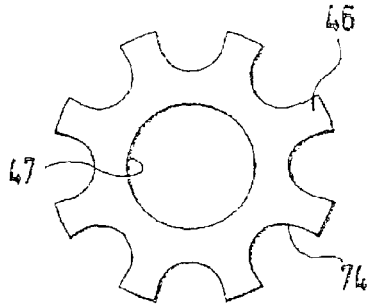

FUEL INJECTION DEVICE FOR INTERNAL COMBUSTION ENGINES, HAVING A COMMON RAIL INJECTOR FUEL SYSTEM

CROSS-REFERENCE TO RELATED APPLICATIONS

This application is a 35 USC 371 application of PCT/DE 02/01435 filed on Apr. 18, 2002.

BACKGROUND OF THE INVENTION

1. Field of the Invention

The invention relates to a fuel injection device for internal combustion engines, in particular a common rail injector, having a housing with an injection end, having a recess extending in the housing, having at least one axially movable valve element, which is disposed in the recess, cooperates with a valve seat, and has a pressure face, remote from the injection end, that axially defines a control chamber, having a sleeve part that radially defines the control chamber, and having at least one device that urges the sleeve part toward a first housing portion and urges the valve seat in the direction of the injection end.

2. Description of the Prior Art

One fuel injection device known on the market involves a common rail injector. In it, the control chamber is defined by an axial end face of a valve needle. Radially, the control chamber is defined by a sleeve part, in whose wall there is an inlet throttle. On the side opposite the valve needle, the control chamber is defined by a housing part in which there is an outlet throttle. The inlet throttle communicates with a high-pressure inlet, while conversely the outlet throttle communicates with a low-pressure region via a control valve. The throttling action of the inlet throttle is greater than that of the outlet throttle.

Between the sleeve part and an annular shoulder of the valve needle, a compression spring is braced. On the one hand it urges the valve needle against a valve seat in the region of the injection end, and on the other, it urges the sleeve part against the housing part. To lift the valve needle from its valve seat in the region of the injection end, the pressure in the control chamber is lowered. The normal high pressure continues to prevail at a pressure face of the valve needle. If the pressure difference is great enough, the closing force of the compression spring is overcome, causing the valve needle to move.

The object of the present invention is to refine a fuel injection device of the type described above in such a way that with it, the fuel can be injected even more precisely.

In a fuel injection device of the this type, this object is attained in that the device, which put the sleeve part against a first housing portion and the valve element in the direction of the injection end under prestressing, includes separate prestressing devices, wherein one prestressing device acts upon the valve element, and another prestressing device acts upon the sleeve part.

SUMMARY OF THE INVENTION

In the invention it has been recognized that leaks between the sleeve part and the first housing portion are equivalent to an enlarged cross section of the inlet throttle. If there is a leak between the sleeve part and the first housing portion, then if a pressure drop is initiated in the control chamber the fuel can flow into the control chamber faster than is wanted, causing the pressure in the control chamber to rise again too fast. This leads to a premature closure of the valve element.

Such a leak between the sleeve part and the first housing portion is avoided in the fuel injection device of the invention.

This is achieved by providing that the force with which the sleeve part is urged against the first housing portion can be selected to be sufficiently high that there is optimal sealing between the sleeve part and the first housing portion. However, such a high pressing force is possible only by providing separate prestressing devices for the sleeve part and for the valve element, respectively.

To enable furnishing the requisite pressing force for the necessary sealing between the sleeve part and the first housing portion, a very rigid spring is in fact required. On the other hand, if an opening motion of the valve element is to be accomplished at even a slight pressure drop in the control chamber, then the prestressing device that acts on the valve element must be relatively nonrigid. Such individual embodiments of the various prestressing devices are possible, in the fuel injection device of the invention.

The fuel injection device of the invention thus in an extremely economical and simple way permits optimal sealing between the sleeve part and the first housing portion, which makes a precise, replicable pressure course in the control chamber possible. This in turn enables a precise opening and closing of the fuel injection device.

Advantageous refinements of the invention are disclosed. In a first refinement, the prestressing device, which acts on the sleeve part, is braced on a second, stationary housing portion. With this kind of bracing, the forces required for good sealing between the sleeve part and the first housing portion can readily be absorbed.

In addition, the sealing can be improved by providing that the sleeve part has a sharp edge, extending all the way around, with which it rests on the first housing portion.

Advantageously, an opening that forms an inlet flow throttle for the control chamber is present in the wall of the sleeve part. Such an inlet throttle can be introduced into the sleeve part in a simple way and with extremely high precision.

It is also possible that the prestressing device which acts on the sleeve part is braced on a shoulder of the recess in the housing. Since the recess in the housing in which the valve element is disposed is generally embodied as a stepped bore anyway, such a shoulder can be provided without great added expense.

One advantageous possibility of designing the prestressing device for the sleeve part is that the prestressing device includes a disk spring, with an opening through which the valve element extends. Such disk springs, which can optionally also be disposed in the form of a spring packet, have a very high rigidity. With them, high pressing forces between the sleeve part and the first housing portion can thus be realized, which is advantageous for the sealing desired. Moreover, such disk springs are quite compact in structure.

In another refinement, at least one recess is present in the disk spring, in the region of the radially outer edge. In that case, the space in which the disk spring is disposed can also be used for guiding the flow of the fuel. In that case, the fuel can flow through the recess.

Alternatively, the prestressing device that acts on the sleeve part can include a spring sleeve. A spring sleeve of this kind has the general shape of a cylinder and makes bracing possible at a point axially remote from the sleeve part.

It is preferred if at least one opening is present in the wall of the spring sleeve. In that case, the spacing which the spring sleeve is disposed can also be used as a flow conduit for the fuel. It is then especially preferred if an inlet flow throttle is present in the wall of the spring sleeve. Such an opening, with a predetermined cross section, can be made easily and inexpensively in the spring sleeve without adversely affecting either its rigidity or its useful life.

It is also possible that the prestressing device that acts on the sleeve part includes a spring element with a support portion and at least two axially extending spring portions. In a spring element of this kind as well, the bracing can be done axially remote from the sleeve part. Since the spring element includes individual spring portions, with interstices between them, the flow through the space in which the spring element is disposed is impaired only slightly if at all.

The invention also relates to a fuel system, which has a fuel injection device that injects the fuel directly into the combustion chamber of an internal combustion engine, at least one high-pressure fuel pump, and a fuel collection line to which the fuel injection device is connected.

In such fuel systems, to improve the precision of the injections performed, it is proposed that the fuel injection device be embodied as described above.

The invention moreover relates to an internal combustion engine having at least one combustion chamber, into which the fuel is injected directly.

To optimize the operation of this engine in terms of fuel consumption and emissions, it is proposed that the engine have a fuel system of the type defined above. Since with this fuel system, the metering of the fuel into the combustion chamber is effected quite precisely, both emissions and fuel consumption can be kept low.

BRIEF DESCRIPTION OF THE DRAWINGS

Below, exemplary embodiments of the invention are described in detail in conjunction with the accompanying drawing. Shown in the drawing are:

FIG. 1: a fragmentary longitudinal section through a first exemplary embodiment of a fuel injection device for internal combustion engines, with a prestressing device for a sleeve part;

FIG. 2: a plan view on the prestressing device of FIG. 1;

DESCRIPTION OF THE PREFERRED EMBODIMENTS

Figure 3:
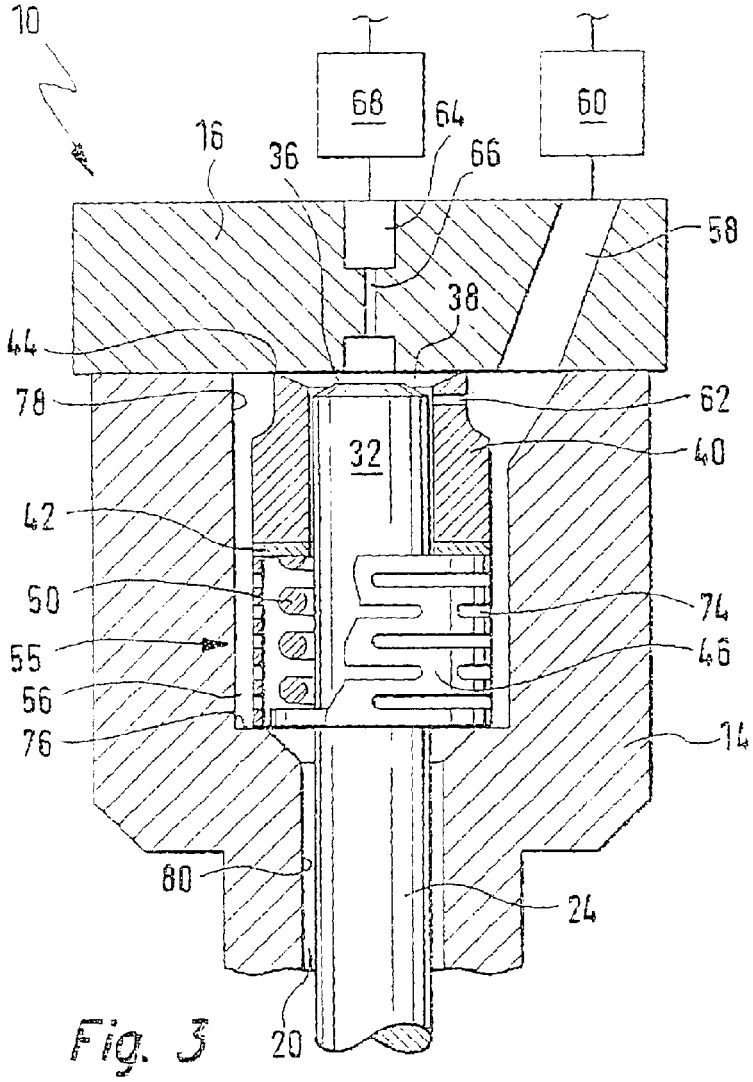
FIG. 3: a fragmentary longitudinal section through a region of a second exemplary embodiment of a fuel injection device for internal combustion engines, with a prestressing device for a sleeve part.

In FIG. 1, a fuel injection device is identified overall by reference numeral 10. It is a common rail injector, which is used for the direct injection of highly compressed fuel into the combustion chamber of an internal combustion engine. The injector 10 includes a multi-part housing 12. The housing 12 includes a nozzle body 14 and a shim 16. The nozzle body 14 and the shim 16 are braced against one another via a nozzle lock nut, not shown in the drawing.

The lower end of the nozzle body 14 in terms of FIG. 1 is embodied as an injection end 18. A recess 20 extends in the nozzle body 14, in the longitudinal direction thereof. This recess takes the form of a stepped bore and ends in the injection end 18. At the injection end 18, there are a plurality of fuel outlet openings 22 distributed over the circumference of the injection end 18. A valve element 24 is disposed in the recess 20 in the nozzle body 14. This valve element is a valve needle, which extends coaxially to the recess 20 and is axially movable. The valve needle 24 cooperates with a valve seat (not identified by reference numeral) in the region of the injection end 18.

The valve needle 24 has a plurality of portions of different diameter: Between a portion 26 of smaller diameter and a portion 28 of larger diameter, there is an oblique pressure face 30. Above the portion 28 is a portion 32, which is smaller in diameter than the portion 28. Above the portion 32 in turn, the valve needle 24 has an end portion 34, whose diameter is somewhat greater than that of the portion 32. The end portion 34 is defined axially at the top by a pressure face 36.

The pressure face 36 in turn axially defines a control chamber 38. Radially, the control chamber 38 is defined by a sleeve part 40, which extends downward to approximately the level of the transition between the end portion 34 and the portion 32 of the valve needle 24. The end portion 34 is guided tightly in the sleeve part 40. The upper edge of the sleeve part 40 has a conical chamfer, forming a knife-edge-like biting edge 44, with which the sleeve part 40 rests on the shim 16. The shim 16 defines the control chamber 30 at the top.

Disposed below the sleeve part 40 is a shim 42, through whose opening the portion 32 of the valve needle 24 passes with some play. The shim is acted upon at the top by an annular disk spring 46. With its radially outer edge, the disk spring 46 is braced on a shoulder 48 of the recess 20. The portion 32 of the valve needle 24 passes through a center opening 47 in the disk spring 46.

A helical compression spring 50 is braced in turn on the disk spring 46. The helical compression spring 50 is disposed coaxially to the valve needle 24. At the bottom, the helical compression spring 50 is supported on an annular collar 52 of a guide sleeve 54. The disk spring 46 and the helical compression spring 50 are part of an impacting device 55. The inside diameter of the guide sleeve 54 is somewhat less than the outside diameter of the portion 28 of the valve needle 24. The guide sleeve 54 is therefore braced on the shoulder formed between the portion 28 and the portion 32 of the valve needle 24.

Between the sleeve part 40, shim 42 and guide sleeve 54, on the one hand, and the wall of the recess 20 in the nozzle body 14. on the other, there is an annular chamber 56. It communicates with a high-pressure collection line 60 via a flow conduit 58. A bore that forms an inlet throttle 62 is made in the wall of the sleeve part 40, in its upper region.

In the shim 16, in its radial center, there is a through bore 64, which has one portion with a slight diameter that forms an outlet throttle 66. The diameter of the inlet throttle 62 is less than that of the outlet throttle 66. Via the through bore 64 with the outlet throttle 66, the control chamber 38 communicates with a switching valve 68. This valve is connected in turn, on its outlet side, to a low-pressure region (not identified by reference numeral).

The annular chamber 56 communicates, through axial conduits in the nozzle body 14 that are made into the wall of the recess 20, with an annular pressure chamber 70 that is present in the recess 20 at the level of the pressure face 30. From the pressure chamber 70, a further annular chamber 72, when the valve needle 24 is open, leads as far as the fuel outlet openings 22. A plurality of semicircular recesses 74 are made in the outer edge of the disk spring 46, distributed over its circumference. Through these recesses, the region of the annular chamber 56 above the disk spring 46 communicates with the region below the disk spring 46. For the embodiment of the recesses 74 in the disk spring 46, see FIG. 2.

The injector 10 shown in FIG. 1 functions as follows:

When the injector 10 is closed, the switching valve 68 is closed. In that case, the full system pressure prevails in the control chamber 38, and this full system pressure also prevails in the high-pressure collection line 60, in the flow conduit 58, in the inlet throttle 62, and in the annular chamber 56. This pressure acts on the pressure face 36 on the upper end of the valve needle 24. As a result, and because of the action of the helical compression spring 50, the valve needle 24 is pressed against the injection end 18 of the nozzle body 14. The fuel outlet openings 22 are thus disconnected from the annular chamber 72, and so no fuel can emerge.

In order to perform an injection with the injector 10, the switching valve 68 is opened. Since the diameter of the outlet throttle 66 is greater than that of the inlet throttle 62, more fuel flows out of the control chamber 38 to the low-pressure region than flows in again through the inlet throttle 62. Thus the pressure in the control chamber 38 drops. At the same time, the full system pressure prevails in the pressure chamber 70 and acts on the pressure face 30 of the valve needle 24. Once the resultant force at the pressure face 30 exceeds the closing force exerted by the helical compression spring 50 and the force originating at the pressure face 36, the valve needle 24 lifts from the valve seat in the region of the injection end 18 and uncovers the fuel outlet openings 22.

To terminate an injection, the switching valve 68 is closed again. Fuel continues to flow into the control chamber 38 through the inlet throttle 62, until the same pressure prevails in the control chamber 38 as in the annular chamber 56 and at all other points inside the injector 10. By the pressure on the pressure face 36 of the valve needle 24 and because of the force that is exerted on the valve needle 24 by the helical compression spring 50, the valve needle 24 is moved in the direction of the injection end 18 again, and the communication between the fuel outlet openings 22 and the annular chamber 72 is interrupted.

In order for the instant of closure of the valve needle 24 to match the desired value as exactly as possible, the pressure course in the control chamber 38 must also correspond as exactly as possible to the desired course. The desired course is varied in turn by means of an exact dimensioning of the inlet throttle 62, on the one hand, and the outlet throttle 66, on the other.

To prevent fuel from the annular chamber 56 from reaching the control chamber 38 through a gap between the sleeve part 40 and the shim 16 (which would correspond to a larger diameter of the inlet throttle 62), the disk spring 46 is embodied quite rigidly. As a result, the biting edge 44 is pressed with a very high pressing force against the wall of the shim 16, which creates optimal sealing. At the same time, however, the helical compression spring 50 is so soft that the opening process of the valve needle 24 is unimpaired.

In FIG. 3, a second exemplary embodiment of an injector 10 is shown. Elements that are functionally equivalent to elements that have already been described in conjunction with FIGS. 1 and 2 have the same reference numerals. They will not be addressed again in detail.

Figure 4:
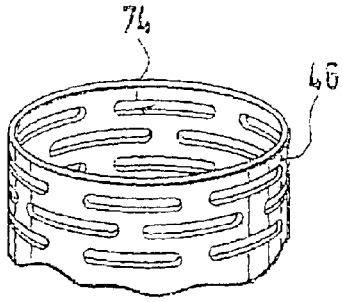
FIG. 4: a perspective view of the prestressing device of FIG. 3.

The essential differences pertain to the design of the prestressing device, which urges the sleeve part 40 against the shim 16. Instead of a disk spring, in the injector shown in FIG. 3 a spring sleeve 46 is provided. It essentially comprises a hollow cylinder (see FIG. 4), in whose wall there are openings 74 that are elongated in the azimuth direction.

The upper edge of the spring sleeve 46 is braced on the shim 42. The lower edge of the spring sleeve 46 is braced on a shoulder 76, which is formed between a region 78 of larger diameter in the recess 20 and a region 80 of smaller diameter in the recess 20. Fuel can pass through the recesses 74 in the spring sleeve 46.

Figure 5:
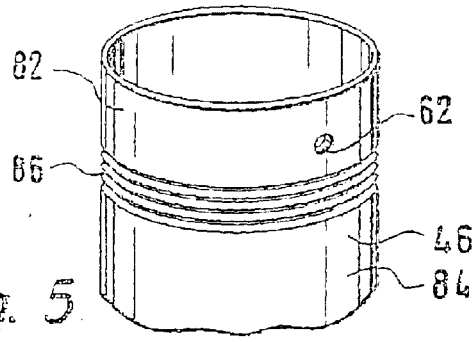
FIG. 5: a modification of the prestressing device of FIG. 4.

A variant of a spring sleeve of this kind is shown in FIG. 5. This spring sleeve 46 has only a single opening in its wall, which forms an inlet throttle 62. Also in this spring sleeve 46, there are two relatively rigid portions 82 and 84, between which there is a spring portion 86 embodied in accordion fashion.

Figure 6:
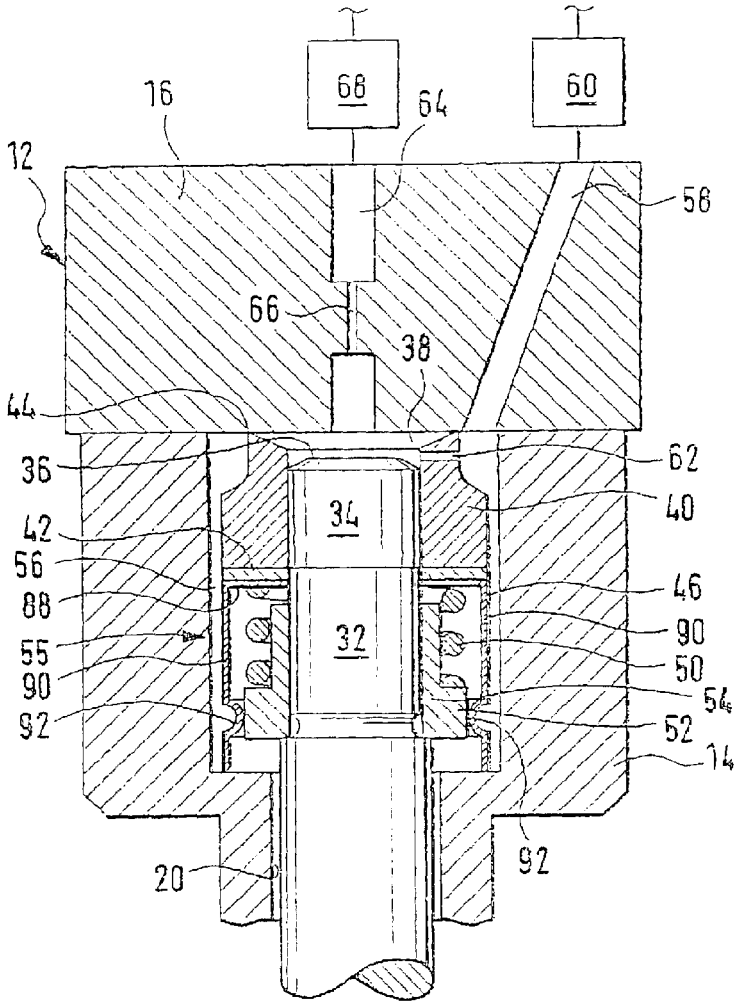
FIG. 6: a view similar to FIG. 1 of a third exemplary embodiment of a fuel injection device for internal combustion engines, with a prestressing device for a sleeve part.

In FIG. 6, a further exemplary embodiment of an injector 10 is shown. Once again, elements that have equivalent functions to elements described in conjunction with FIGS. 1–5 have the same reference numerals and are not described again here in detail.

Figure 7:
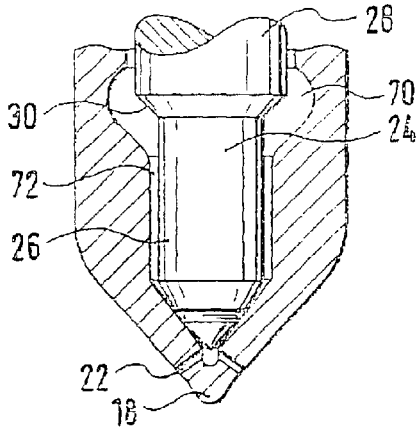
FIG. 7: a perspective view of the prestressing device of FIG. 6.
Figure 7:
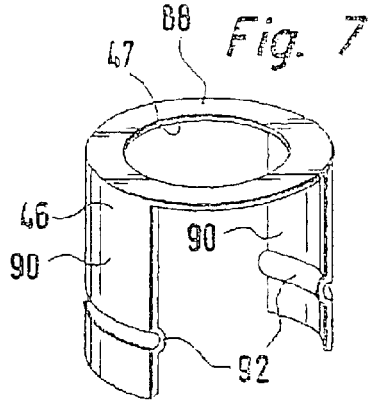

Unlike the injector 10 shown in FIG. 1, in the injector 10 shown in FIG. 6 there is a spring element 46, instead of a disk spring. This spring element has an annular support portion 88, onto which two axially extending spring portions 90 are formed. A semicircular bulge 92 (see also FIG. 7) is bent into each of the spring portions 90, in the region of its lower end in terms of FIG. 6 but spaced apart somewhat from it, and each bulge forms a torsion spring.

Figure 8:
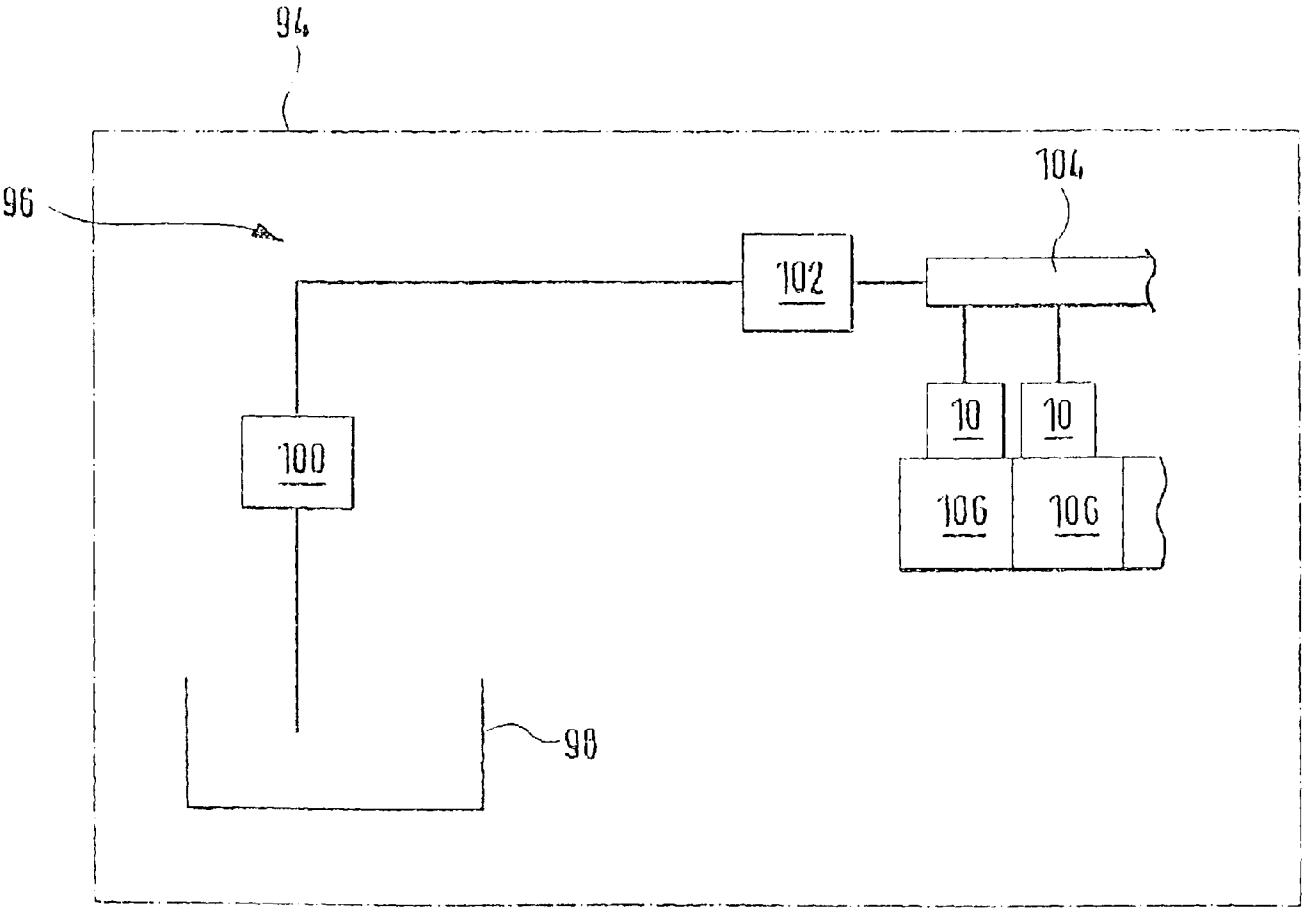
FIG. 8: a basic diagram of an internal combustion engine with a fuel system and a plurality of fuel injection devices of the kind shown in FIG. 1.

In FIG. 8, an internal combustion engine 94 is shown schematically. It includes a fuel system 96. This fuel system in turn has a fuel tank 98, from which an electric low-pressure fuel pump 100 pumps the fuel to a motor-driven high-pressure pump 102. From there, the fuel reaches a fuel collection line 104, which is also generally known as a rail. A plurality of injectors 10, which are embodied according to FIG. 1, FIG. 3 or FIG. 6, are connected to the fuel collection line 104. The injectors 10 each inject the fuel (Diesel or gasoline) directly into combustion chambers 106.

It should also be noted that the terms "top" and "bottom" and "upper" and "lower" in the above description pertain solely to the drawings here. In principle, the device 10 can also be disposed in some other position than that shown in the drawings.

The foregoing relates to preferred exemplary embodiments in the invention, it being understood that other variants and embodiments thereof are possible within the spirit and scope of the invention, the latter being defined by the appended claims.

What is claimed is:

1. A common rail fuel injection device (10) for internal combustion engines (94), comprising a housing (12) with an injection end (18), a recess (20) extending in the housing (12), at least one axially movable valve element (24), which is disposed in the recess (20), cooperates with a valve seat, and which has a pressure face (36), remote from the injection end (18), that axially defines a control chamber (38), a sleeve part (40) that radially defines the control chamber, and at least one device (55) that urges the sleeve part (40) toward a first housing portion (16) and urges the valve element (24) in the direction of the injection end (18), the device (55) including separate prestressing devices (46, 50), wherein one prestressing device (50) acts upon the valve element (24), and another prestressing device (46) acts upon the sleeve part (40).

2. The fuel injection device (10) of claim 1, wherein the prestressing device (46), which acts on the sleeve part (40), is braced on a second, stationary housing portion (14).

3. The fuel injection device (10) of claim 1, wherein the prestressing device (46) which acts on the sleeve part (40) is braced on a shoulder (48) of the recess (20) in the housing (12).

4. The fuel injection device (10) of claim 2, wherein the prestressing device (46) which acts on the sleeve part (40) is braced on a shoulder (48) of the recess (20) in the housing (12).

5. The fuel injection device (10) of claim 1, wherein the sleeve part (40) has a sharp edge (44), extending all the way around, with which it rests on the first housing portion (16).

6. The fuel injection device (10) of claim 2, wherein the sleeve part (40) has a sharp edge (44), extending all the way around, with which it rests on the first housing portion (16).

7. The fuel injection device (10) of claim 1, further comprising an opening in the wall of the sleeve part (40), the opening forming an inlet flow throttle (62) for the control chamber (38).

8. The fuel injection device (10) of claim 2, further comprising an opening in the wall of the sleeve part (40), the opening forming an inlet flow throttle (62) for the control chamber (38).

9. The fuel injection device (10) of claim 3, further comprising an opening in the wall of the sleeve part (40), the opening forming an inlet flow throttle (62) for the control chamber (38).

10. The fuel injection device (10) of claim 5, further comprising an opening in the wall of the sleeve part (40), the opening forming an inlet flow throttle (62) for the control chamber (38).

11. The fuel injection device (10) of claim 7, further comprising an opening in the wall of the sleeve part (40), the opening forming an inlet flow throttle (62) for the control chamber (38).

12. The fuel injection device (10) of claim 1, wherein the prestressing device that acts on the sleeve part (40) comprises a disk spring (46), with an opening through which the valve element (24) extends.

13. The fuel injection device (10) of claim 12, further comprising at least one recess (74) in the disk spring (46), in the region of the radially outer edge.

14. The fuel injection device (10) of claim 1, wherein the prestressing device that acts on the sleeve part (40) comprises a spring sleeve (46).

15. The fuel injection device (10) of claim 14 further comprising at least one opening (74) in the wall of the spring sleeve (46).

16. The fuel injection device (10) of claim 14, further comprising an inlet flow throttle (62) in the wall of the spring sleeve (46).

17. The fuel injection device (10) of claim 1, wherein the prestressing device that acts on the sleeve part (40) comprises a spring element (46) with a support portion (88) and at least two axially extending spring portions (90).

18. A fuel system (96) comprising a fuel tank (98), at least one fuel injection device (10) which injects the fuel directly into the combustion chamber (106) of an internal combustion engine (94), at least one high-pressure fuel pump (102), and a fuel collection line (104), to which the fuel injection device (10) is connected, the fuel injection device (10) being embodied in accordance with claim 14.

19. An internal combustion engine (94) comprising at least one combustion chamber (106), into which the fuel is injected directly, and a fuel (96) injection device defined in claim 5.

* * * * *

UNITED STATES PATENT AND TRADEMARK OFFICE

CERTIFICATE OF CORRECTION

PATENT NO. : 6,928,985 B2
DATED : August 16, 2005
INVENTOR(S) : Friedrich Boecking It is certified that error appears in the above-identified patent and that said Letters Patent is hereby corrected as shown below:

Title page,
Insert Item -- [30] Foreign Application Priority Data
May 8, 2001 (DE) ……. 101 22 256 --.

Signed and Sealed this

Fourth Day of October, 2005

JON W. DUDAS
*Director of the United States Patent and Trademark Office*